US011051555B2

(12) United States Patent
Hon

(10) Patent No.: US 11,051,555 B2
(45) **Date of Patent: *Jul. 6, 2021**

(54) GAS COMBUSTION HEATING SMOKING ARTICLE

(71) Applicant: Lik Hon, Beijing (CN)

(72) Inventor: Lik Hon, Beijing (CN)

( * ) Notice: Subject to any disclaimer, the term of this patent is extended or adjusted under 35 U.S.C. 154(b) by 666 days.

This patent is subject to a terminal disclaimer.

(21) Appl. No.: 15/579,584

(22) PCT Filed: Jan. 20, 2017

(86) PCT No.: PCT/CN2017/071902
§ 371 (c)(1),
(2) Date: Dec. 4, 2017

(87) PCT Pub. No.: WO2018/068438
PCT Pub. Date: Apr. 19, 2018

(65) Prior Publication Data

US 2019/0223496 A1 Jul. 25, 2019

(30) Foreign Application Priority Data

Oct. 10, 2016 (CN) ..... 201621111124.8

(51) Int. Cl.
*A24F 42/10* (2020.01)
*A24F 42/60* (2020.01)
(Continued)

(52) U.S. Cl.
CPC ..... *A24F 47/006* (2013.01); *A24D 3/18* (2013.01); *A24F 13/00* (2013.01); *A24F 13/08* (2013.01);
(Continued)

(58) Field of Classification Search
CPC ..... A24F 47/006; A24D 3/18
(Continued)

(56) References Cited

U.S. PATENT DOCUMENTS 1,498,190 A * 6/1924 Morrier ..... A24F 13/16 131/174
5,060,671 A * 10/1991 Counts ..... A24F 47/008 131/329
(Continued)

FOREIGN PATENT DOCUMENTS

CN 2643681 Y 9/2004
CN 2648836 Y 10/2004
(Continued)

OTHER PUBLICATIONS

Machine Translation of WO 2017075975 (Year: 2017).*
Machine Translation of CN 103712246 (Year: 2014).*

*Primary Examiner* — Eric Yaary
*Assistant Examiner* — Russell E Sparks
(74) *Attorney, Agent, or Firm* — Bayramoglu Law Offices LLC

(57) ABSTRACT

The present invention discloses a kind, of gas combustion heating smoking article with puff mouth piece. The gas heating smoking article includes a smoking article housing, a combustion device, a plurality of cigarette consumable items or a plurality of aerosol generation consumable items. The combustion device uses propane or butane premixed with air before combustion, heat generated from the combustion is used to bake the cigarette consumable items or aerosol generation consumable items. The present invention provides a low temperature smoking article using gas as energy, which generates quite similar taste of normal cigarette, to people who have difficulty to quite smoke. Because there is no cigarette burning, this smoking article can reduce many harmful products compared to the traditional cigarette due to its tobacco burning and heat degradation, like tar, carbon monoxide, ash, etc.

6 Claims, 15 Drawing Sheets

(51) Int. Cl.

| | |
|---|---|
| ***A24F 47/00*** | (2020.01) |
| ***A24F 13/00*** | (2006.01) |
| ***A24D 3/18*** | (2006.01) |
| ***A24F 13/08*** | (2006.01) |
| *A24D 3/04* | (2006.01) |
| *F23Q 3/00* | (2006.01) |

(52) U.S. Cl.
CPC ..... *A24F 42/10* (2020.01); *A24F 42/60* (2020.01); *A24F 47/004* (2013.01); *A24D 3/04* (2013.01); *F23Q 3/002* (2013.01)

(58) Field of Classification Search
USPC ..... 131/329
See application file for complete search history.

(56) References Cited

U.S. PATENT DOCUMENTS

| | | | | |
|---|---|---|---|---|
| 5,880,439 | A | 3/1999 | Deevi et al. | |
| 6,536,442 | B2 * | 3/2003 | St. Charles | A24F 47/004 131/185 |
| 7,997,280 | B2 * | 8/2011 | Rosenthal | A61M 11/041 128/202.21 |
| 8,291,918 | B2 * | 10/2012 | Magnon | A24F 47/006 128/202.21 |
| 9,016,274 | B1 * | 4/2015 | White | A61M 15/00 128/202.21 |
| 9,149,072 | B2 | 10/2015 | Conner et al. | |
| 9,185,939 | B2 | 11/2015 | Jarriault et al. | |
| 9,220,301 | B2 | 12/2015 | Banerjee et al. | |
| 10,010,113 | B2 * | 7/2018 | Zuber | A24F 47/004 |
| 2013/0255703 | A1 | 10/2013 | Banerjee et al. | |
| 2014/0360517 | A1 * | 12/2014 | Taggart | A24F 47/008 131/329 |

FOREIGN PATENT DOCUMENTS

| | | | | | |
|---|---|---|---|---|---|
| CN | 1328992 | C | | 8/2007 | |
| CN | 103712246 | A | * | 4/2014 | |
| CN | 2004200311820 | A | | 4/2014 | |
| CN | 103987286 | A | | 8/2014 | |
| CN | 104854195 | A | | 8/2015 | |
| CN | 204682514 | U | | 10/2015 | |
| CN | 105979802 | A | | 9/2016 | |
| CN | 206062123 | U | | 4/2017 | |
| WO | WO-2017075975 | A1 | * | 5/2017 | A24F 47/00 |

* cited by examiner

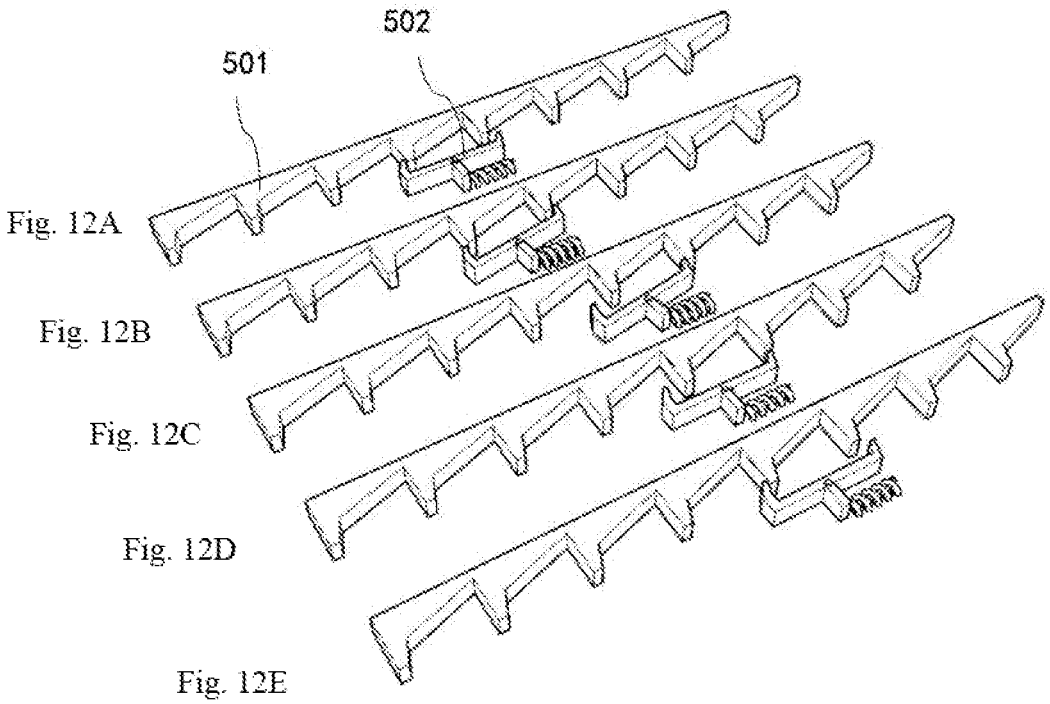
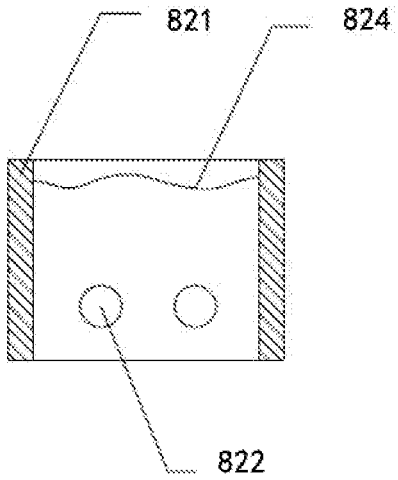
Fig. 13A
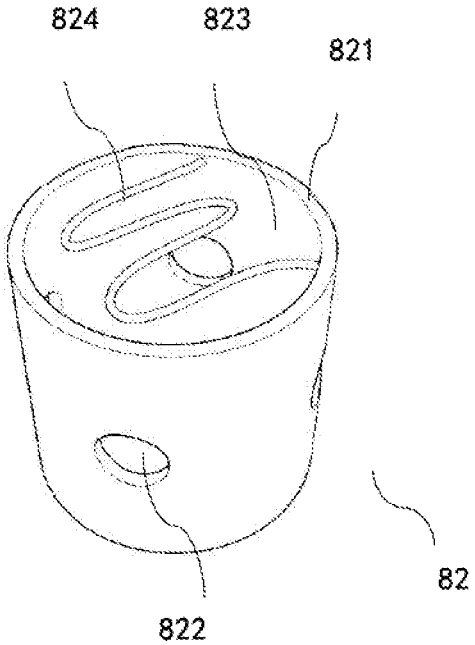
Fig. 13B

GAS COMBUSTION HEATING SMOKING ARTICLE

CROSS REFERENCE TO RELATED APPLICATIONS

This application is the national phase entry of International Application No. PCT/CN2017/071902, filed on Jan. 20, 2017, which is based upon and claims priority to Chinese Patent Application No. CN201621111124.8, filed on Oct. 10, 2016, the entire contents of which are incorporated herein by reference.

TECHNICAL FIELD

This invention relates to a smoking article, especially a kind of gas heating smoking article.

BACKGROUND

Ordinary tobacco product, for example cigarette, is made by wrapping cigarette paper around cut tobaccos in the shape of round bar or rod. More often than not, a filtering device, for example a filter tip made of cellulose acetate, is attached to the smoking end of cigarettes. When the smoker lights a cigarette and puffs, the cut tobaccos in cigarette will get burnt and carbonized to form a flame-free hot combustion zone. The combustion zone gradually expanding backward, will give rise to high-temperature air flow which exerts a carbonization effect on neighboring cut tobaccos. Besides, the high-temperature air flow will vaporize the volatiles contained in the cut tobaccos and generate visible aerosol, namely whitish and lightly-bluish vapor, when such volatiles are cooled by the incoming cooling air. The nicotine contained in such vapor will be breathed into human blood system through respiratory tract as well as pulmonary alveoli and then excite cerebral nerve cells, exposing smokers to the pleasant feeling exclusive to nicotine. However, the decomposition and double-decompose reactions of various chemicals from tobaccos will give rise to large quantities of tar and diversified harmful substances. Hence it comes as a constant challenge to cigarette manufacturers to bring smokers the pleasant feeling created by mildly-harmful nicotine while minimizing tar and hazardous substances. To significantly improve the public health environment and weaken the harm of tobaccos and the resulting law conflicts, great efforts are being made in relevant technological improvements and inventions. R.J Reynolds Tobacco Company has described, in a number of technological patents, the low-tar cigarettes with segment-based combustion element fueled by carbon. Also relevant technologies have been disclosed in such U.S. Pat. Nos. 9,220,301, 9,149,072 and the 9,185,939 of Philip Morse.

The present inventor also applied to patents of electronic cigarette powered by battery, including the Chinese utility model patents ZL03211903.8, ZL03212882.7 and ZL200420031182.0, etc. in 2003 and 2004. Patent from Philip Morse U.S. Pat. No. 5,880,439 disclosed an electrical powered ceramic heating device, for lighting and heating cigarette. These patents are all focusing on providing low tar cigarette with traditional cigarette's advantages to smokers, and reduce incomplete combustion and pyrolysis products. So, e-cigarette begins standing out on global cigarette market, recent e-cigarette products are welcomed by the world due to its free tar, easy to use. There are 10 million people using e-cigarette. However, there are still some technic problems of e-cigarette without ideal solution, like the problem from lithium battery, heating element over heating causing carbon degradation makes it is impossible to add tobacco extraction to liquid, this limited the taste of e-vapor, makes long term smokers will not accept it.

Targeting the lighting method of cigarette, China utility model patent CN204682514U disclosed a filter mouth piece with lighter, by a supporting structure combined cigarette and lighter together, for smoker smoking. However, cigarette need lighter to ignite directly, harmful combustion products filtered. China invention patent CN1328992C disclosed a smoking simulation article and its fuel units, using clean fuel to combust, like ethanol, methyl alcohol, isopropanol or propyl alcohol, etc. Obviously, enjoy the happiness of nicotine but reduce the damage of tar and other harmful product is a problem of tobacco companies. To significantly improve the public health environment, reduce the damage of tobacco and legal conflicts, related technical improvement and science invention are all working on these problems. People are looking for a tobacco substitution which could reduce the harmful products from combustion, and provides a good, convent smoking experience.

SUMMARY OF THE INVENTION

To solve the problems mentioned above, this invention disclosed a cigarette substitute which is safer, no need battery or charge. This invention is a low temperature cigarette heated by premixed gas flame. Core idea of this invention is using the heat generated by gas combustion baking cigarette consumable items or heating aerosol generation consumable items, and generate aerosol very similar to normal cigarette.

To archive the purpose above, this invention provides following solution:

A gas heating smoking article, with puff mouth piece, such smoking article has smoking article housing, combustion device on housing, cigarette consumable items or aerosol generation consumable items; such combustion device using propane and butane gas premixed with air as fuel to generate heat, such heat is for baking cigarette consumable items or heating aerosol generation consumable items.

Selected baking cigarette consumable items could be: cigarette consumable items could be normal cigarette, or cigarette rolled with one of following materials, heat resistance paper, heat resistance member, and metal foil. Such cigarette consumable item is placed in the baking chamber inside the housing, such housing is designed with inlet air hole and puff mouth piece at each side; baking chamber designed at least one combustion gas spread path and exhaust; such premixed gas flame from combustion device is targeting the high-temperature gas hole of the baking chamber which connected to the combustion gas spread path, to bake the cigarette consumable items; there is no air flow path between baking chamber and puff mouth piece.

Furthermore, such combustion device can move along the cigarette consumable items, by ignite premixed gas flame multiple times to bake the cigarette consumable items section by section. Optimized, such cigarette consumable items baking section should be 3-20 sections, corresponding high-temperature spread path should also be 3-20.

Furthermore, such baking chamber is divided into multiple separate chambers by partitions, such partitions designed with a space for cigarette consumable items; there is high-temperature gas spread path and exhaust gas exit for each separate chambers, gap between cigarette consumable item and the housing of the smoking article is the high-temperature gas spread path; combustion device is attached to the outside of the housing, it can move along the smoking article step by step, and at each stop place high-temperature gas inlet hole to separate chambers, single combustion and step motion of the combustion device is controlled manually.

Furthermore, the combustion device is connected the an escapement system to let it move step by step, such escapement system is located outside the housing and each stop point makes the combustion device targeting at least one of the high-temperature gas inlet holes.

Furthermore, there is a manual switch controls the combustion device and escapement system or two switches control these separately.

Furthermore, there is a lid on the housing provides an easy way for user to replace consumable items.

Furthermore, the high-temperature gas spread path could be filled with metal foam or metal fiber, which could let the premixed flame and premixed nameless combustion coexistence.

Furthermore, the combustion device includes fuel chamber, ignition device, gas refill port, inlet air control switch and premix chamber, such premix chamber designed with combustion-supporting air inlet and nozzle, the premixed flame spurt out of the nozzle, optimized, the flame should targeting the high-temperature hole of the baking chamber.

Furthermore, the nozzle is designed with metal wire to stabilize the flame and prevent sudden flameout.

Furthermore, such premix chamber is designed with flame muffler net, to prevent housing damage or housing overheat.

Furthermore, the premix chamber is made of heat resistance ceramic, with multiple inlet air flow hole at the side; or with wave shaped dual metal sheet, which could extended and press to close an air flow valve, multiple inlet air flow holes at the side.

consumable item inserted into silicon. Air flows into the spiral air flow path through opening, the spiral air flow path attached with heat releasing part of heat collector to heat air flows in, high temperature air flows out of the spiral air flow path and targeting cigarette consumable item to heat and generate aerosol.

If using aerosol generation consumable items, the optimized solution should be: the housing is designed with combustion zone and aerosol generation zone, such combustion zone has at least one inlet air hole and exhaust hole; the aerosol generation zone has an inlet air hole for puffing; there is no air flow path between combustion zone and aerosol generation zone; such combustion device is located in combustion zone, the premixed gas combusts in a heat collection system; the aerosol generation consumable item is placed in the aerosol generation zone; heat collected by the heat collection system is released to the aerosol generation zone and generate aerosol.

Furthermore, the aerosol generation consumable items have liquid conduction system, such liquid conduction system is connected to heat releasing units.

Furthermore, the heat collection system is cellular structure, which premixed gas combust in it with or without flame, the heat collection system designed multiple air flow holes on its side wall, there is a heat release unit at its close end.

Furthermore, the heat collection system is designed as multi-fence metal column, filled with metal foam metal column or filled with metal fiber mat metal column. Optimization is, between the heat collection system and housing there is a flame muffler net.

Furthermore, the combustion device includes fuel chamber, ignition device, air flow adjust valve, gas refill port, control switch and premix chamber, such premix chamber designed with air inlet hole and nozzle, premixed gas flame connected to the heat collection system through the nozzle. In the system, the premix chamber is made of heat resistance ceramic with multiple gas exhaust; or with wave shaped dual metal sheet, which could extended and press to close an air flow valve after heated, multiple gas exhaust at the side.

Furthermore selectively, the nozzle is designed with metal wire to stabilize the flame and prevent sudden flameout.

From the perspective of product design, that the combustion device and aerosol generation consumable items are coaxial designed, the smoking article is rod like; or the combustion device is protrude out of the housing of aerosol generation consumable items, the smoking article is pistol like.

This invention also provides a simplified smoking article design, which includes smoking article housing, combustion device on the housing, cigarette consumable items; such combustion device using propane or butane premixed with air before combustion, heat from combustion transferred to air path to heat air inside the air path, the high temperature air outlet targeting cigarette consumable items to heat it and generate aerosol, in this invention, combustion device and cigarette consumable item placed in combustion zone and aerosol generation zone, there is no air flow between them.

Furthermore, such combustion device has heat collection unit, premixed air combusts in heat collection unit, generate heat to heat air inside the air flow path.

Furthermore, air flow path is made of heat conduction material in spiral shape, its inlet air hole connected to the housing to outside air.

Furthermore, inside the aerosol generation zone designed with heat resistant layer prevent combustion and store heat.

Furthermore, end of smoking article housing designed with silicon tube to insert cigarette consumable items, puff mouth piece of cigarette consumable item is outside the silicon tube.

Optimized, the end part of the smoking article designed with removable puff mouth piece, such cigarette consumable items insert into housing or placed in puff mouth piece.

By using aerosol generation consumable item, this invention provides a simplified solution, similar combustion device, different heat collection device. A smoking article, includes smoking article housing, combustion device attached on the housing, aerosol generation consumable item; such combustion device using propane or butane premixed with air before combustion, heat generated from the combustion is transferred to aerosol generation consumable item; the housing designed with combustion zone and aerosol generation zone. Such combustion zone placed with supporting air inlet and at least one waste gas exhaust for exhausting combustion waste gas. Such aerosol generation zone placed with puff air inlet path and puff aerosol outlet path. There is no air flow between the combustion zone and aerosol generation zone, combustion device placed in combustion zone, premix gas combusts in premix chamber, aerosol generation consumable item is in aerosol generation zone. Heat from combustion transfers to aerosol generation consumable item by heat collection device to generate aerosol, such heat collection device located on aerosol generation consumable item. In this design, combustion device includes combustion chamber, ignition device, gas flow adjust valve, gas refill port, control switch and premix chamber. Such premix chamber designed with support air inlet and nozzle, flame mixed with air conducted to heat collection device through such nozzle.

Furthermore, the heat collection device separates the combustion zone and aerosol generation zone. Heat resistance fiber of such aerosol generation consumable item closely attached on heat collection device, to generate aerosol from the aerosol generation material Absorbed by the heat resistance fiber.

Optimized, the heat collection device is made of heat resistance metal foil, and shaped in a structure which could attach close to the heat resistance fiber, located in the end of aerosol generation consumable item housing. Especially, the heat collection device designed with a hollow, inner side of the hollow is shaped closely attached on heat resistance fiber. Specifically, the heat collection device is in cone shape, such heat resistance fiber closely attached on the inner side of the heat collection device. The point of the heat collection device is placed close to the premix chamber.

Furthermore, the heat collection device is sealed on aerosol generation consumable item housing by heat resistance soft part. When inserting aerosol generation consumable item into the smoking article's housing, deformation of the soft part will compress the heat collection device, to make it closely attached on the heat resistance fiber to transfer heat.

Furthermore, the aerosol generation consumable item and heat collection form one consumable item together. Such aerosol generation consumable item designed with air inlet path. One side of the air inlet path connected to outside, the other side connected to the hollow between heat collection and the housing.

Furthermore, the aerosol generation consumable item designed with puff mouth piece connected to puff air outlet, in one piece or separately.

In this invention, since there is no tobacco burning or heating aerosol generation materials, this could reduce or prevent harmful products from tobacco burning and degradation, there is no tar, carbon monoxide and ash, no secondhand smoke issue, no environmental pollution, thus will significantly reduce the damage from traditional tobacco. Considering the propane, butane gas combustion process could produce waste gas, this technical solution designs single puffing air flow path which is isolated with combustion waste gas path, in the baking chamber and consumable items chamber, to prevent the health of smokers.

BRIEF DESCRIPTION OF THE DRAWINGS

For better understanding of the following figures, reference to the application embodiments is recommended. These illustrative figures do not serve as restrictions to technological solutions of the invention at all. In particular, structures, ratio, sizes are only for instruction for people familiar with the technology, reading and understanding, there is no limit to the invention's implementation.

FIGS. 12A, 12B, 12C, 12D and 12E are segment sketches of the escapement system for one complete stepping motion;

FIGS. 13A and 13B are two illustrations of two kinds of premixing chamber of this invention;

FIG. 14 is an illustration of example 3; in this figure the housing is filled with aerosol generation consumable items, smoking article is rod like;

FIGS. 16A, 168, 16C and 16D are illustrations of heat collector, in the figure there are four kinds of different material, structure heat collectors.

FIG. 17 is an illustration of example 4; in the figure the housing is filled with aerosol generation consumable item, smoking article is pistol like.

DETAILED DESCRIPTION OF THE INVENTION

Figure 1A:
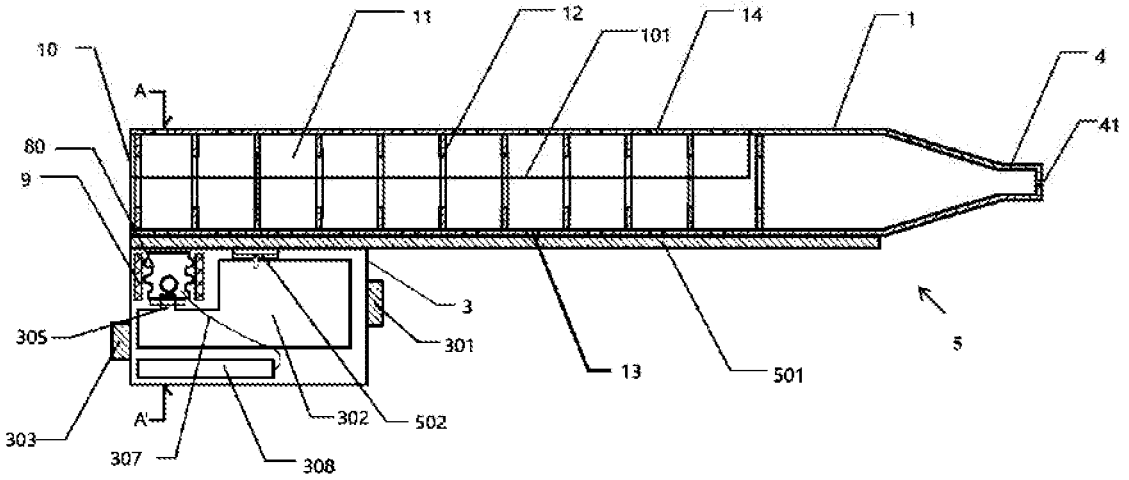
FIG. 1A is a section view of this invention gas heating smoking article, the smoking article could insert cigarette in its housing, and one push button controls combustion device and stepping motion.

The following drawings and specific embodiments will describe the present invention in detail.

For the terms used herein, cigarette consumable items refers to any filling material used in the smoking articles, particular the cigarettes, which can be either the conventional material, such as normal tobacco, nontobacco plant, signal or hybrid carbon fuel material, there is no limitation of materials in this invention, and there is no limitation of manufacture process and supporting materials. In this invention, traditional tobacco materials like cut tobacco, broken tobacco and tobacco particles, or other special processed tobacco, like being dry distillation or extracted of tobacco leaf (of course by changing the distillation or extraction level could provide different tobacco taste), low nitrosamine content tobacco, low tar tobacco, protein removed tobacco, low protein carbonized processed tobacco, etc. also can add PG, VG, nicotine, tobacco extract, tobacco flavor, ethanol may apply one or more compositions, among tobacco flavors, like sweeteners, aloes, mint, licorice, essence, etc., could be used to change the taste or flavor of cigarette. Carbon fuel material is porous carbide, solid carbon fuel like charcoal rod, porous carbide herein is carbide made from tobacco leaf, tobacco artificial sheet, by high temperature vacuum distillation partially or completely. Currently, solid carbon rod fuel materials have been commercialized and could be customized and sell, like Premier brand released in 1988 and Eclipse released in 1995 from R.J. Reynolds tobacco are heat-not-burn tobacco products. Apparently, in this invention, cigarette consumable items are working as one time products, it could be traditional cigarette, or tobacco rolled with heat resistance paper, member and aluminum foil. The outside of the cigarette could apply a high temperature baking material as packing, however the packing is the focusing point of this invention, so for examples blow will using aluminum foil, but there is no limitation for this invention.

Aerosol generation consumable items, aerosol generation material refers to liquid which form aerosol after heating and cooling, any liquid in current tobacco product could be applied, like liquid in e-cigarette. As we known, liquid could be categorized into two classes: with nicotine and without nicotine, main composition are PG, VG, nicotine, tobacco extract, tobacco flavor, ethanol may apply one or more compositions, among tobacco flavors, like sweeteners, aloes, mint, licorice, essence, etc., could be used to change the taste or flavor of cigarette; optimized, to fulfill needs, can also add appropriate nicotine and/or tobacco extracts, to replace traditional cigarette products. Aerosol generation material is usually placed in proper container, and conducted by good liquid conduction material like fiber mat, fiber wick consist replaceable or liquid refillable consumable items. In current technology, aerosol generation consumable items are wildly used in e-cigarette, thousands of recipes; there is no limitation in this invention.

Combustion device refers to combustion device using propane gas or butane gas premixed with air to generate flame, ignition and combustion structure is similar to premix lighter. The theory of premix lighter is premix gas with air then combust. Main parts of combustion device are: ignition device and gas storage tank, ignition device can generate and shoot spark to combustion zone to generate flame. Common ignition devices are: piezoelectric ceramic element, magnetic inductance and battery, etc. By using piezoelectric ceramic element, for example, applying mechanical stress on piezoelectric ceramic will cause the element's internal chargers' center change and polarize the element and generate free chargers at both sides of the element. So once the piezoelectric ceramic element being compressed, it could convert mechanical energy to electrical energy, and release high voltage spark at a sharp point to ignite gas. Technicians in this field should understand, the premix lighter is a mature technology. This invention has no limitation to premix lighter, only use it as a combustion device for baking cigarette, will do some necessary modification on its appearance, premix chamber, nozzle and cooperate structure with smoking articles.

Filtering element placed in the cigarette consumable item's puff area or in front of puff mouth piece, filtering element could be used for removing tar and other harmful materials in the smoke, reduce the uncomfortable feel after puff, typical filtering material is made of acetate fiber, polyester, polypropylene mesh. Of course there are some filters with special functions and structures. This invention has no limitation to filters' structure, material and function.

The main idea of this invention is providing a cigarette substitute, with propane gas or butane gas as energy, premixed flame to heat low temperature cigarette, and heat from combustion is for baking cigarette consumable items or aerosol generation consumable items, and generates smoke similar to traditional cigarette.

Applying cigarette consumable items in the smoking article need design reasonable baking chamber in the smoking article. Depends on the length of the consumable item, there could be 1 or more baking chamber, optimized 3-20 baking chamber, the purpose of the baking chamber is match up smoker's smoking habit and rhythm, also bake the cigarette consumable item as uniform as possible. For baking chamber, since the propane gas or butane gas produce waste gas during combustion, should place waste gas emission outlet to the outside world.

Figure 1B:
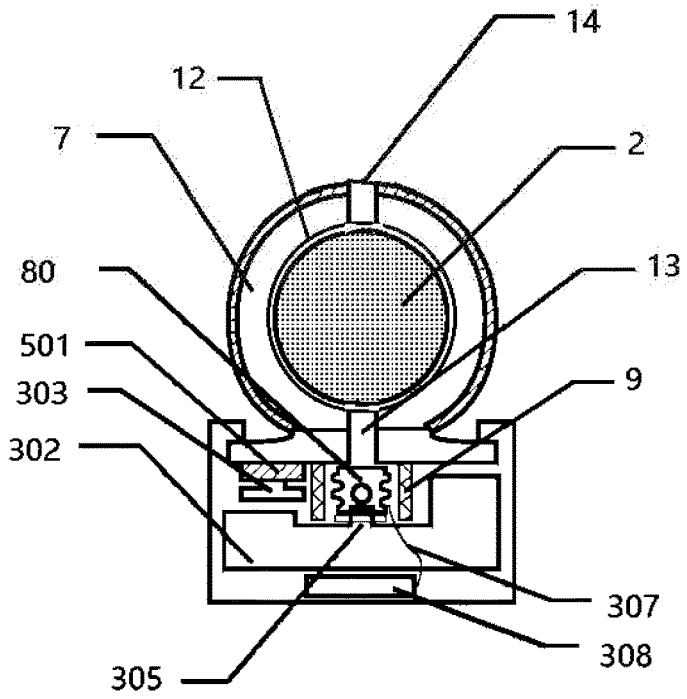
FIG. 1B is a section view from FIG. 1A A-A direction; there is cigarette consumable items in the housing.
Figure 2:
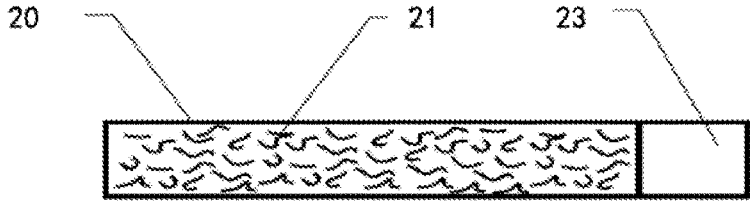
FIG. 2 is a cigarette consumable items illustration.

As shown in FIGS. 1A and 1B, a low temperature smoking article, includes housing 1, rod shape cigarette consumable item 2 and combustion device 3, smoking article housing is basically made of heat resistance material, like heat resistance ceramic, one side with an opening for inserting cigarette consumable items, this opening also works as combustion supporting air inlet, the other side of the smoking article is designed as a mouth piece 4, or connected to a removable mouth piece 4, the mouth piece designed with a puff hole 41. Combustion device 3 connected to the smoking article's housing by a step escapement system. Ignition of combustion device 3 and step moving of step escapement system controlled by same push button 303. As shown in FIG. 2, cigarette consumable item 2 is rolled by aluminum foil 20 and tobacco material 21, one side is the filter. If apply removable mom piece 4, the filter could place in the mouth piece.

Inside the smoking article's housing 1, there are baking chambers 11, separated by partitions 12, all these partitions have reserved with center holes for inserting cigarette consumable items. When inserted with cigarette consumable items 2, each baking chamber 11 is a sealed space, each baking chamber 11 designed a high-temperature gas inlet hole 13 and waster gas outlet hole 14, also the gap between the cigarette consumable item 2, the smoking article's housing 1 and the partition 12 is a high-temperature gas separation path 7, to realize the uniform baking of the cigarette consumable items. Optimized, the high-temperature gas separation path 7 could be designed in 3 to 20's, which means the cigarette consumable item 2 is divided into 3 to 20 sections for baking. Furthermore optimized, to increase the heat efficiency metal fiber or metal foam could be add into the high-temperature gas separation path 7, let the premixed flame and premixed flameless combustion coexistence.

One side of combustion device 3 is placed with liquid propane or butane gas tank 302 and the tank has gas charging valve and gas flow adjust valve, the other side of the gas tank 302 is placed with a push button 303 and stop valve 304, stop valve 304 connected to gas nozzle 305, gas nozzle 305 placed in premix chamber 80 and close to high voltage ignition wire 307, push button 303 connected with piezoelectric ceramic or high frequency device 308 through high voltage ignition wire 307 to premix chamber 80.

Figure 3:
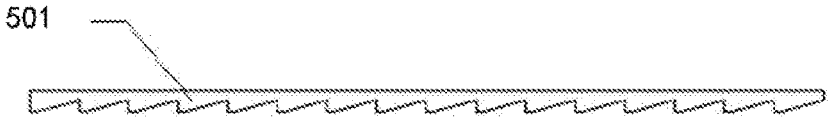
FIG. 3 is an illustration of rack in the escapement system of this invention.
Figure 4:
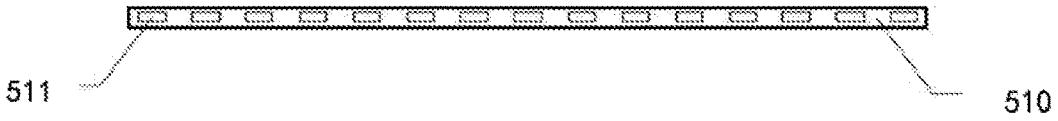
FIG. 4 is an illustration of hole-rack in the escapement system of this invention.
Figure 5A:
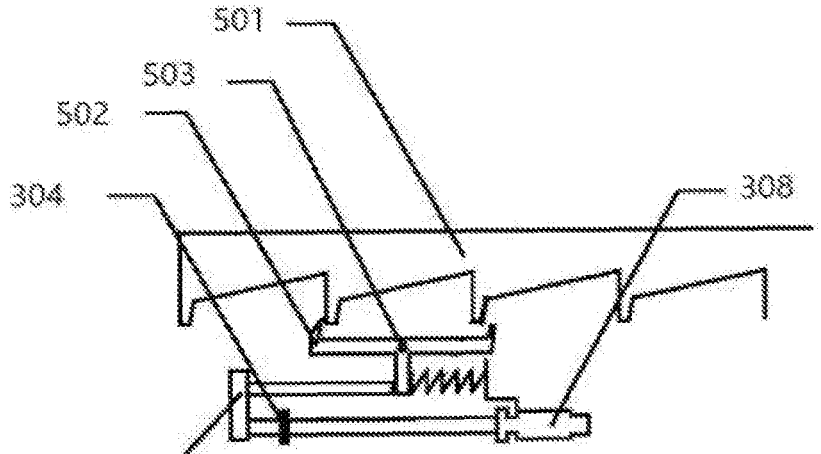
FIGS. 5A, 5B, 5C, 5D and 5E are segment sketches of the escapement system for one complete stepping motion.
Figure 5B:
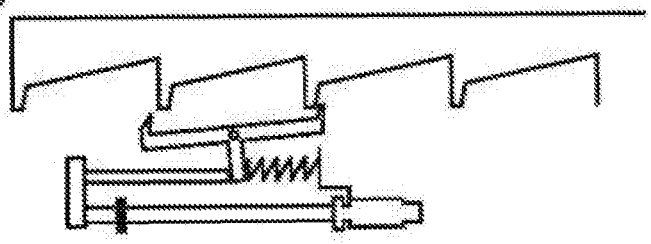
Figure 5C:
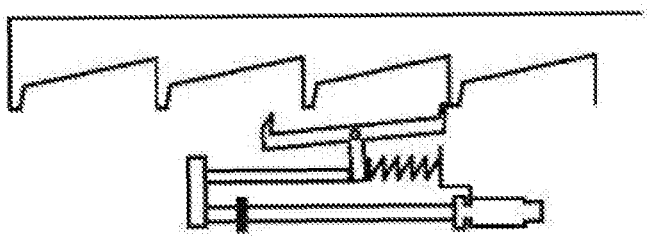
Figure 5D:
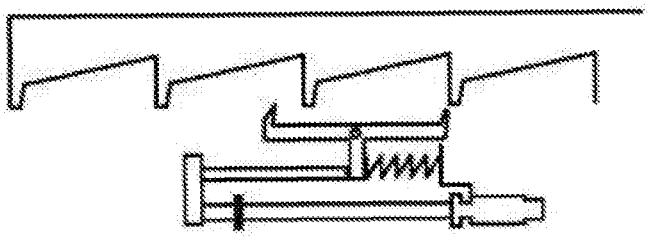
Figure 5E:
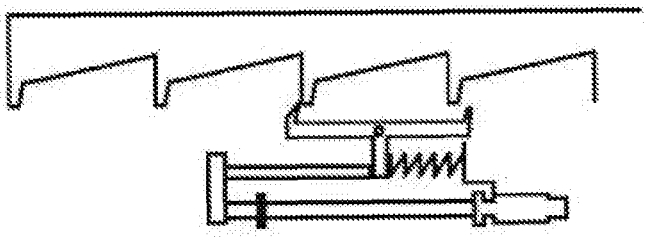
Figure 6:
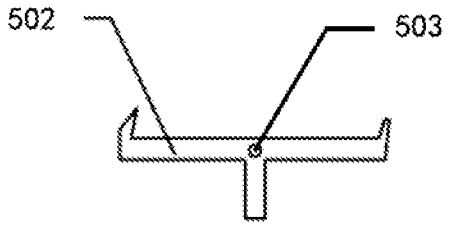
FIG. 6 is an illustration of tooth in the escapement system of this invention.
Figure 7:
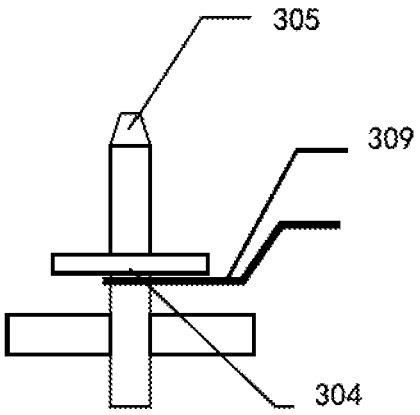
FIG. 7 is an illustration of combustion device nozzle and stop valve of this invention.

Step escapement system is placed on the smoking article's housing; main purpose is to realize the step movement of combustion device on the housing. Control a device moving in steps is a mature technology; there is no limitation for this design. Connection between housing 1, combustion device and step escapement device could apply any current technology. In this invention, to provide a good experience, the push button 303 on combustion device controls not only the single ignition but also the step movement of the escapement system. In FIG. 3, the rack 501 in the escapement system is a long strip plate with tooth, placing on the housing 1, at each stop point, the nozzle 803 of the premix chamber 80 on the combustion device facing each high-temperature gas inlet 13. FIGS. 5A, 5, 5C, 5D and 5E are the illustration of one step movement of the escapement system, these figures are only for illustrate the step movement, there is no limitation for the escapement system. By applying a force on push button 303, connecting rod 505 will press piezoelectric ceramic 308 and pawl 502, piezoelectric ceramic triggered, pawl 502 move towards next teeth, at the same time the connecting rod 505 and metal sheet 309 push stop valve 304, so, combustion gas is ejected and ignited, combustion device moves to next stop point on rack 501. In FIG. 6 illustrates the structure of pawl 502, it has an active pawl shaft 503. As one option, in FIG. 4, in the escapement system can replace the step rack to rack with position holes 511 long strip plate 510.

Figure 8B:
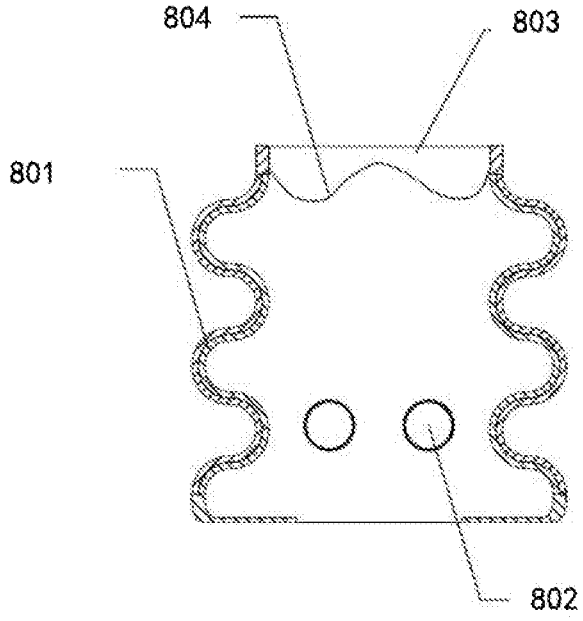
FIGS. 8A and 8B are two illustrations of wave shaped metal sheet mixing chamber of this invention.
Figure 8A:
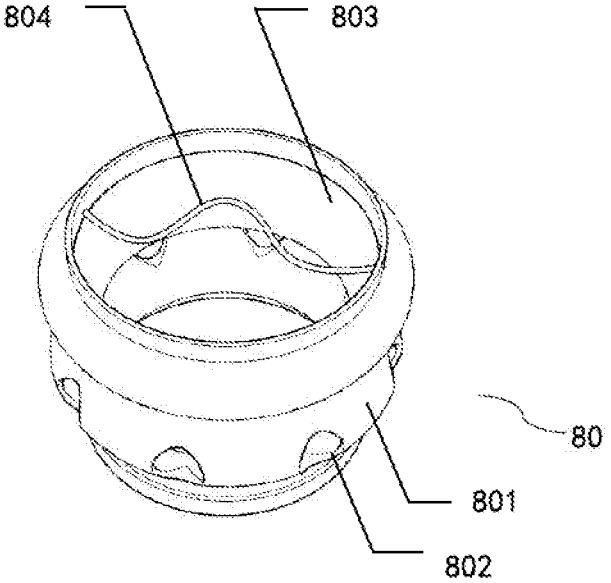
Figure 9A:
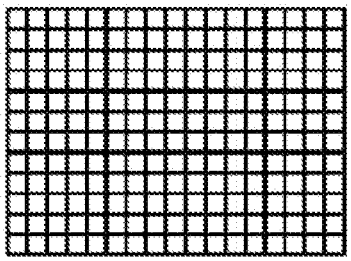
FIGS. 9A and 9B are two illustrations of flame muffler in this invention.
Figure 9B:
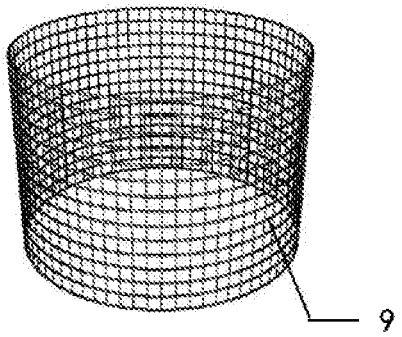

In FIGS. 8A and 8B, premix chamber 80 working as a chamber for mixing air and combustion gas could be made of metal, optimized using dual metal sheet material, side wall 801 of premix chamber designed with air inlet hole 802, and designed curved stable heating wire 804 at the flame nozzle 803. Flame stable wire 804 could prevent sudden flame out when in high temperature. Described dual metal sheet material also called heat dual metal sheet, which means the shape of the composite material could be change by temperature. Because the thermal expansion coefficient of each layer is different, when temperature changes, shape change of active layer is greater than passive layer, thus makes the dual metal sheet curve to the passive layer, the change in the curvature of the composite material to produce deformation. In this example, to prevent over heat, premix chamber 80 applies wave shaped dual metal sheet. If there generate too much heat the dual metal sheet will expand by heat and press the stop valve to reduce the gas ejection. As an optimized, in FIGS. 9A and 9B, in above mentioned example, around the premix chamber 80 placed with flame muffler net 9. Premix flame nozzle 803 connected to one of many high-temperature gas separate path 7 through high-temperature gas hole 13 on baking chamber. Wasted gas from combustion exhausted from waste gas 14 opposite high-temperature gas hole 13. Cigarette consumable item 2 in baking chamber 11 will be baked and generate aerosol, aerosol will be puffed through the cigarette consumable item, filter 23 and mouth piece 4.

Figure 10:
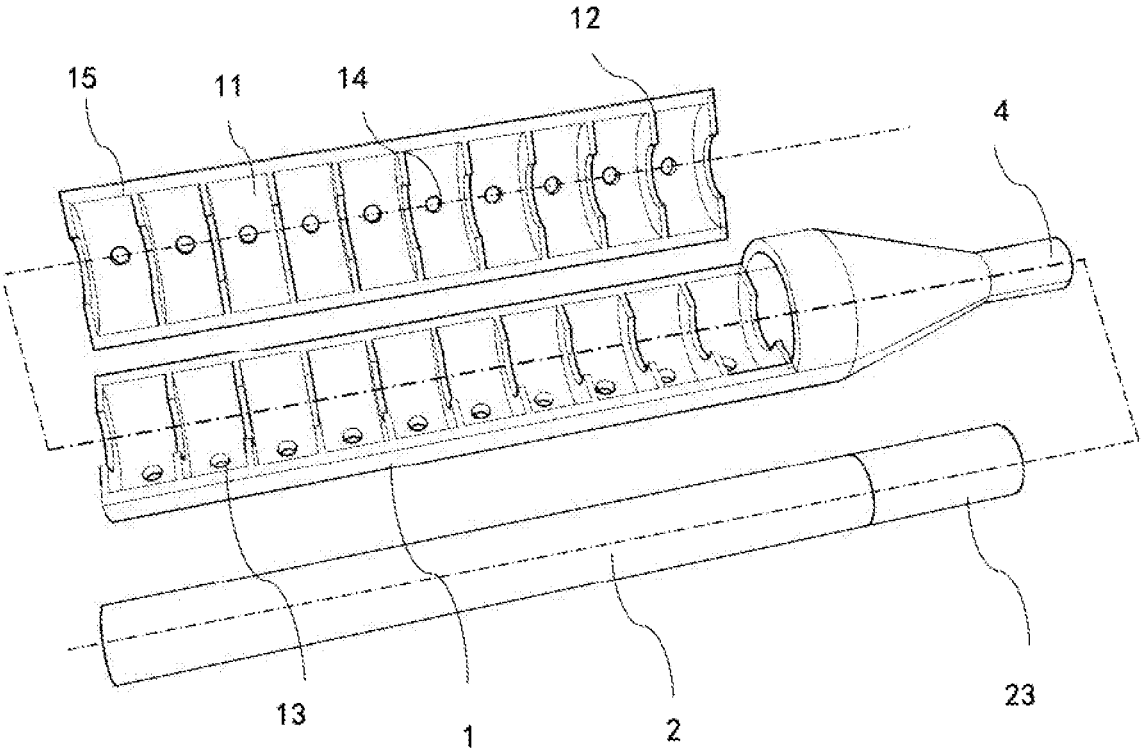
FIG. 10 is an illustration of the housing, in the figure there is a removable lid, but no combustion device.

As one option, in FIG. 10, for a better solution to replace cigarette consumable items, there is a removable lid 15 designed on housing 1. The connection could be pin joint, socket, etc. Removable lid 15 designed with waste gas outlet hole 14. The external shape of housing 1 is depends on product design, combustion device and step escapement system connection, beauty and function, there is no limitation on this.

By pressing push button 303 continually, pawl 502 moves around pawl shaft 503, the device moves along one tooth on rack 501 to complete one step movement. At the same time, the push button 303 also moves stop valve 304 and piezoelectric ceramic 308, to complete ignition process. At every step movement stop point, nozzle on combustion device 3 always facing a baking chamber's high-temperature hole 13. Before puffing, press push button 303, continually, until whole cigarette consumable item finished baking. Remove cigarette consumable item 2 by open the lid 15, or just remove cigarette consumable item 2, and discard it away.

Figure 11:
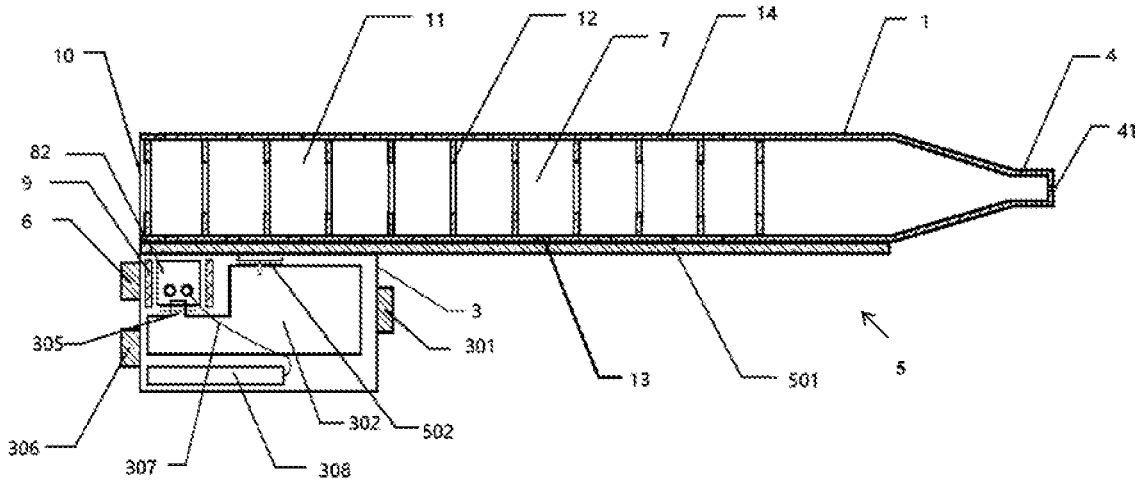
FIG. 11 is an illustration of example 2; in the figure the housing filled with cigarette consumable item, and controlled by different buttons for combust and stepping.

As shown in FIG. 11, this invention disclosed another low temperature cigarette, which has similar structure mentioned above, includes smoking article housing 1, cigarette consumable item 2 and combustion device 3, one side of the housing 1 designed with an opening 10 for inserting cigarette consumable items, the other side placed with a puff mouth piece 4 and the mouth piece has a puff hole 41. Combustion device 3 connected to housing 1 by escapement system 5. The difference is the combustion device 3 controlled by push button 306, escapement system 5 controlled by push button 6. As shown in FIGS. 13A and 13B, premix chamber 82 of combustion device 3 is made of ceramic and in cylindrical shape, on its wall 821 designed with multiple support air inlet hole 822, combustion stable wire 824 placed near flame nozzle 823.

In this invention, escapement system 5 and push button 6 connected to pawl 502 and rack 501 to complete step movement. When user press push button 306, stop valve 304 will open, piezoelectric ceramic 308 triggered and generated high voltage. Based on the Bernoulli Equation, propane and butane gas ejected from nozzle drag combustion supporting air into premix chamber, ignited by electrical arc. Once the push button 306 pressed, the ignition process triggers, from FIGS. 12A, 12B, 12C, 12D and 12E is the escapement system theory, by pressing push button 6, the escapement system and its pawl 502, rack 501 will push combustion chamber 3 move to next high-temperature gas path 7 towards puffing mouth piece 4 to complete the section baking process. Based on theory mentioned above, technicians in this field can design the high-temperature gas spread path from perpendicular to the long axis of cigarette consumable item to parallel to the long axis of cigarette consumable item, by multiple partitions which placed along the circumferential direction of cigarette consumable item to form high-temperature gas spread path, such path paralleled with cigarette consumable item, 3-10 high-temperature gas spread path circumferential around cigarette consumable item, controlled by a kind of revolving escapement system to make high-temperature gas spread path aim combustion chamber.

In the following example, optimized the structure once more, removed the escapement system, and replaced the cigarette consumable items to aerosol generation consumable items. The aerosol generation consumable items have metal or plastic housing, filled with aerosol generation liquid, such aerosol generation liquid includes but not only propylene glycol, glycerin, nicotine and tobacco extract, flavor, water, and in the alumina powder mixture composed of one or more of the following, and using heat resistance fiber wick or mat to conduct liquid by capillary effect.

Figure 14:
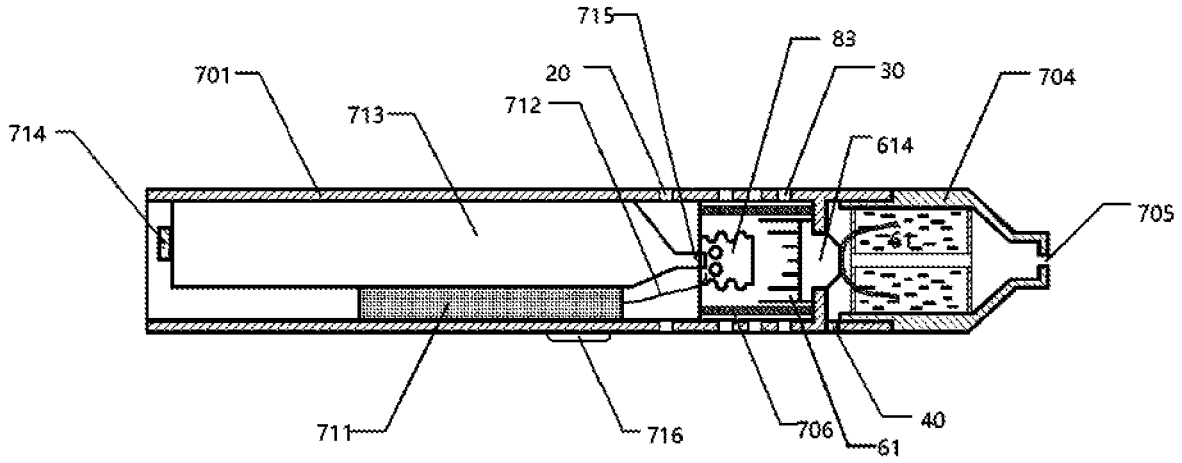

As shown in FIG. 14, this invention provides a smoking article, its housing in rod shape, made of heat resistant resin, glass, metal, etc. It has upper housing 701 and lower housing 704, connection between these two could be threaded connection, plug and other appropriate activities, inside of the upper housing 701 is combustion zone, placed combustion device with gas charging valve and gas adjust valve 714, gas tank 713 filled with liquid propane and butane, gas nozzle 715, piezoelectric ceramic or high frequency device 711, high voltage ignition wire 712 and push button 716, such push button 716 optimized on the wall of housing 701, gas nozzle connected to premix chamber 83, premix chamber optimized with combustion stable wire, premixed gas combust in heat collector 61, heat collector 61 rounded by flame muffler 706, heat collected by heat collector 61 released to aerosol generation consumable items. Upper housing 701 designed with support air inlet hole 20 and waste gas exhaust hole 30.

Figure 15:
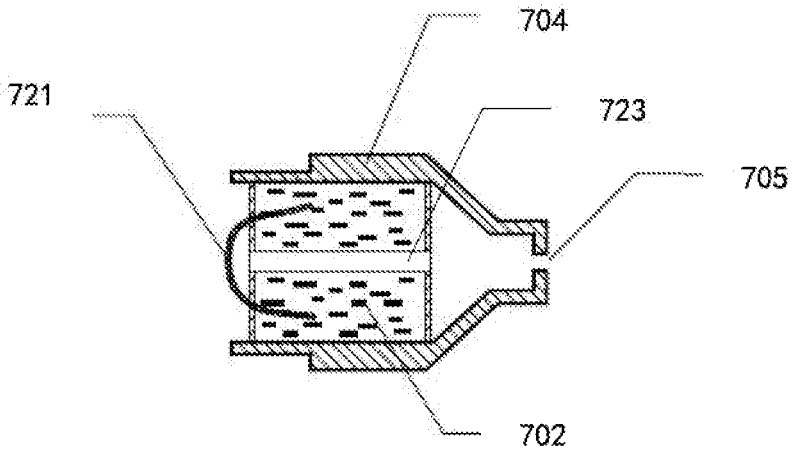
FIG. 15 is an illustration of heat resistance fiber aerosol generation consumable item in this invention.
Figure 16A:
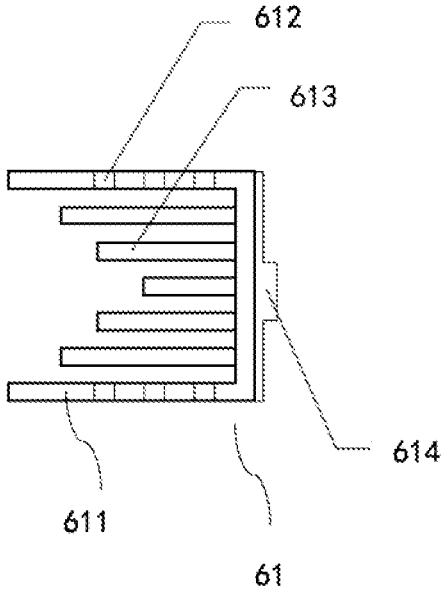
Figure 16B:
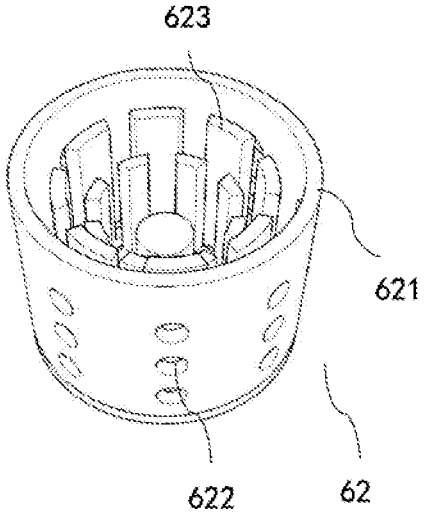
Figure 16C:
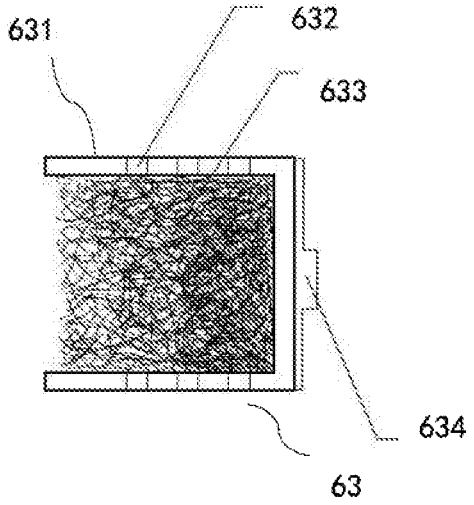
Figure 16D:
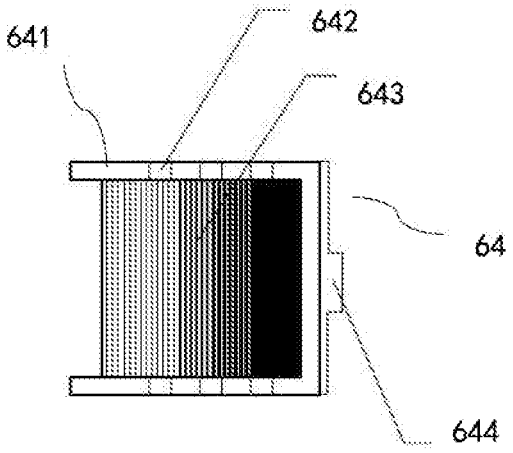

FIG. 15, inside lower housing 704 is aerosol generation zone, aerosol generation consumable items placed in it, one side of lower housing 704 connected to upper housing 701, the other side is puff mouth piece 705 or connected to removable puff mouth piece 705, puff mouth piece 705 designed with puff hole, aerosol generation zone in upper housing 701 designed with puff air inlet hole 40, there is no air flow between aerosol generation zone and combustion zone, only heat transfer occurs. Aerosol generation consumable items designed with liquid conduction device, such conduction device has air flow path 723. In this example, liquid conduction device is made of heat resistant fiber wick 721, two ending of liquid conduction wick 721 immerge into aerosol generation liquid 702.

Optional heat collectors as shown in FIGS. 16A, 16B, 16C and 16D. In these heat collectors, 61, 62, 63 and 64 are made of heat resistant metal in cylindrical shape, on its side wall 611, 621, 631 and 641 designed with air path hole 612, 622, 632 and 642, at the bottom designed with heat release part 614, 634, and 644 (heat releasing part of heat collector 62 not shown in FIG. 16B), these heat releasing part connected to aerosol generation consumable item's liquid conduction device. The differences of these heat collectors are their inside structure and filling material, heat collector 61 and 62 using multi-fence structure, as shown figure, multi metal strip paralleled with space in between, or multi metal column in ring shape with space in between, optimized, metal strip with different height from outside to inside; as shown in figure, heat collector 63 filled with metal foam or metal fiber 633, heat collector 64 filled with metal mat, premixed gas will combust in those small space in metal foam and fiber and mat, that's called premixed nameless combustion.

When user press push button 716, wave shaped dual metal sheet premix chamber 83 inside wave shaped premix chamber 83 form premixed gas ignited by arc combust in flameless inside heat collector 61. Liquid conduction wick 721 absorbs heat from heat collector and generate aerosol, aerosol cooled by air from puff inlet air hole 40 and puffed by smoker.

Figure 17:
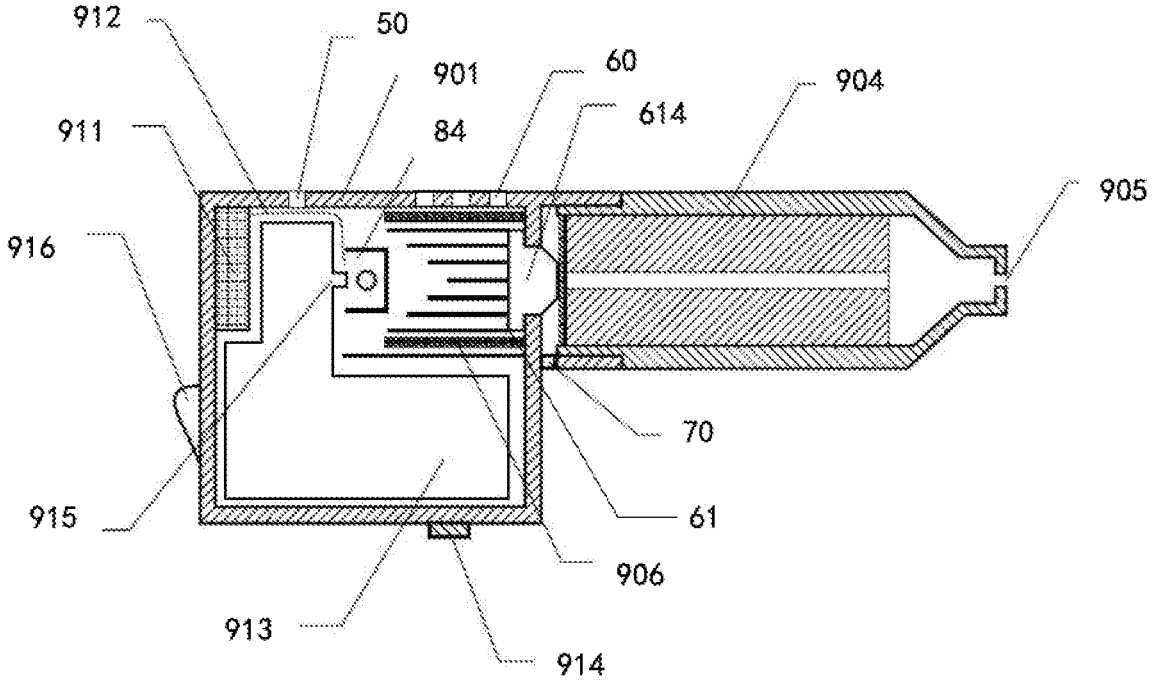
Figure 18:
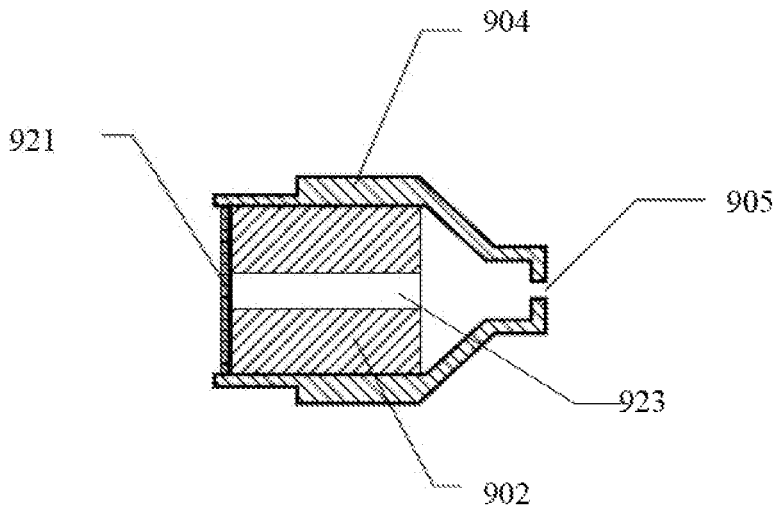
FIG. 18 is an illustration of heat resistance fiber mat aerosol generation consumable item.

Similar to above mentioned theory, as shown in FIG. 17 and FIG. 18, this invention provides a smoking article, such smoking article's housing is pistol liked, easier for holding. Smoking article has upper housing 901 and lower housing 904, they can be connected and removed, upper housing 901 placed with combustion device, which has gas charging valve, gas flow adjust valve 914, fuel tank 913, gas nozzle 915, piezoelectric ceramic or high frequency device 911, high voltage wire 912 and push button 916, push button 916 optimized placed at the front of upper housing 901, gas nozzle connected to premix chamber 84, premix chamber designed with combustion stable wire, the premix chamber is made of ceramic.

Premix gas combust in heat collector 61, heat collector 61 rounded with flame muffler, heat released through heat releasing unit from heat collector 61 to heat aerosol generation consumable item. Upper housing 901 designed with support air inlet hole 50 and multiple waste gas exhaust hole 60, upper housing also designed with puff air inlet hole 70.

Figure 19:
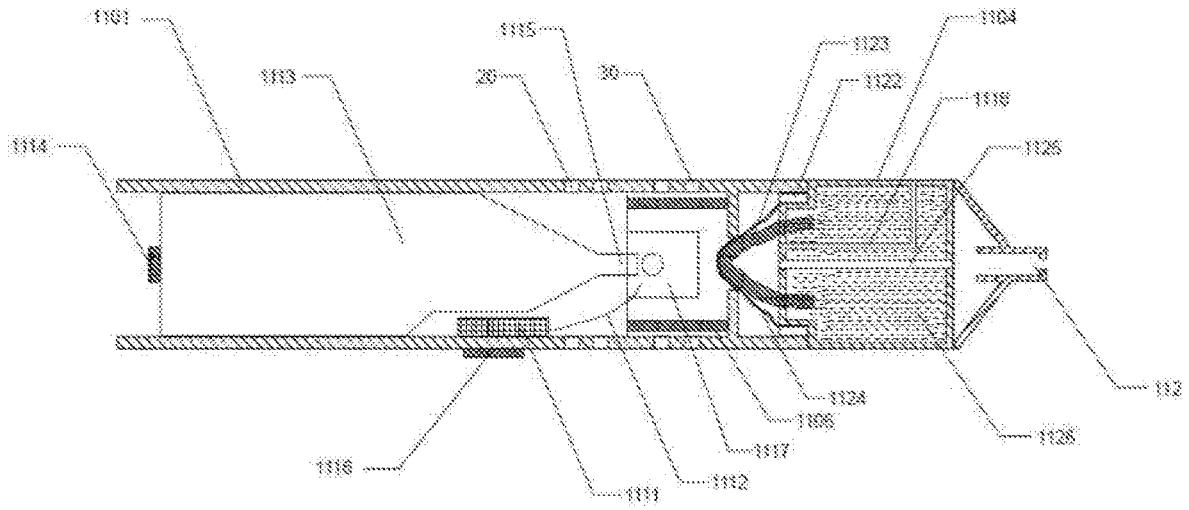
FIG. 19 is an illustration of a simplified solution with aerosol generation consumable item, in this figure, heat collection device and aerosol generation consumable item are in one piece.
Figure 20:
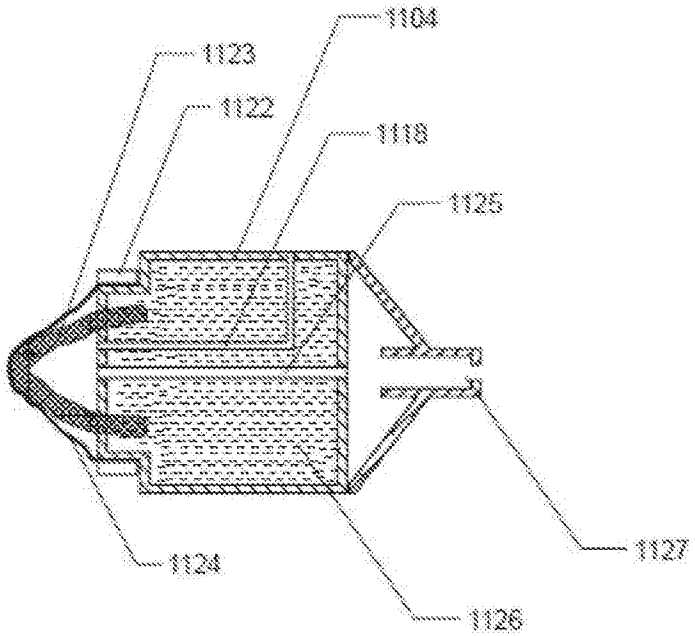
FIG. 20 is an illustration of aerosol generation consumable item, in this figure, heat collection device and aerosol generation consumable item are in one piece.

Lower housing 904 placed with aerosol generation consumable items, at the end of it designed with puff mouth piece 905. Aerosol generation consumable items designed with air flow path 923. In this example, liquid conduction device is made of heat resistant fiber mat 921, two end point of liquid conduction mat 921 attached to fiber column 902 absorbed aerosol generation liquid.

shown in FIG. 19 and FIG. 20, this example provides a simplified smoking article design of heating cigarette consumable item by using metal foil like nickel foil to replace permanent heat collection device. A smoking article device including housing 1101, combustion device, aerosol generation consumable item on housing 1104; like previous examples, combustion device using propane or butane premixed with air before combustion, combustion device designed with gas refill port and gas flow valve 1114, fuel tank with butane or propane 1113, gas nozzle 1115, piezoelectric ceramic or high frequency device 1111, high voltage ignition wire 1112 and push button 1116. Heat from combustion transferred to aerosol generation consumable item 1104, aerosol generation consumable item 1104 filled with aerosol generation material 1126. Smoking device housing is divided by combustion zone and aerosol generation zone. Combustion zone placed with supporting air inlet 20 and at least one waste gas exhaust 30 for exhausting combustion waste gas. Aerosol generation zone placed with puff air inlet path 1118 and puff aerosol outlet path 1125. There is no connection between combustion zone and aerosol generation zone, to prevent waste gas cause damage to smokers' health. Combustion device placed in combustion zone, premixed gas combusts in premix chamber 1117, such aerosol generation consumable item placed in aerosol generation zone, heat from combustion transferred to aerosol generation consumable item by heat collection foil 1124. Structure of metal foil heat collection device 1124 optimized shaped closely attached with fiber 1123, place the metal foil heat collection device in front of aerosol generation consumable item, the shape could be but not limited a hollow, to place the inside of the hollow closely attach with heat resistance fiber 1123.

In this example, heat collector 1124 could be made of metal foil like nickel foil and shaped in cone shape, heat resistance soft part silicon 1112 seal it with aerosol generation consumable item 1104 at heat resistance fiber 1123, compress the cone shaped heat collector 1124 to make it closely attached with heat resistance fiber 1123 to transfer heat fast. Once the aerosol generation consumable item 1104 inserts in smoking article 1101, top point of heat collector 1124 placed close to the premix chamber 1117, premix chamber 1117 surrounded by flame muffler net 1106. The top of cone shaped heat collector 1124 could be designed round or flat, to increase the contact area of flame, furthermore to increase the aerosol generation speed, optimized a bullet head shape. The space between cone shaped heat collector 1124 and premix chamber 1117 is combustion zone, space between heat collector 1124 and heat resistance fiber 1123 is aerosol generation zone, the combustion zone and aerosol generation zone separated by heat collector 1124. The housing of aerosol generation consumable item 1104 designed with an air inlet path 1118, such air inlet path 1118 connects outside air and space in heat collector, such structure refers to current e-cigarette's similar structure, place an outside inlet air path 1118 in aerosol generation zone, to cool down and from aerosol, meanwhile, such aerosol generation consumable item 1104 also designed with a puff path 1125. Press push button 1116, piezoelectric or high frequency device 1111 ignite premixed gas in premix chamber 1117 generates flame, cone shaped heat collection device transfer heat to heat resistance fiber 1123, liquid in heat resistance fiber 1123 transferred to aerosol, aerosol puffed out by path 1125 and mouth piece 1127. This design has an advantage is fast heat transfer without thermal inertia, heat resistance metal foil heat collector and aerosol generation consumable item 1104 could be disposed together, no carbonyl from repeated usage of heat collector.

Figure 21:
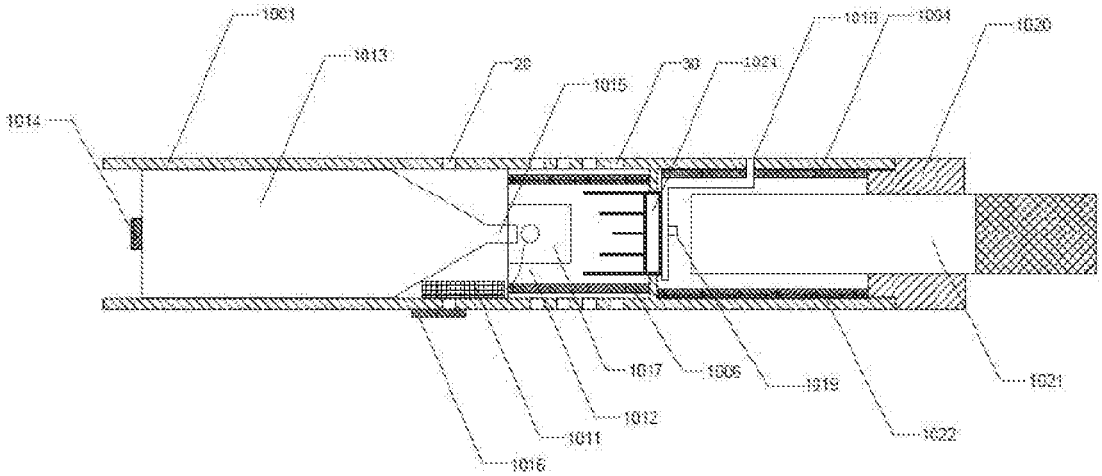
FIG. 21 is an illustration of simplified smoking article design, including spiral air flow path.

As shown in FIG. 21, this example provides a simplified smoking article design of heating cigarette consumable items. The housing is in rod shape, made of heat resistant resin, glass, metal, etc. It has front housing 1001 and back housing 1004, separated by partition, space inside front housing 1001 is combustion zone, combustion device placed inside, combustion device includes gas charging valve and gas flow adjust valve 1014, tank filled with propane and butane 1013, gas nozzle 1015, piezoelectric ceramic or high frequency 1011, high voltage ignition wire 1012 and push button 1016, the push button optimized designed on the front housing 1001, as nozzle connected to premix chamber 1017, premix chamber optimized with combustion stable wire, premixed gas combust in heat collector 1014, heat collector 1014 rounded by flame muffler 1006, front housing 1001 designed with support air inlet hole 20 and waste gas exhaust hole 30. Back housing 1004 is aerosol generation zone; there is no air connection between aerosol generation zone and combustion zone. Cigarette consumable item 1021 insert and locate in silicon tube 1020, filter part of cigarette consumable item 1021 outside the silicon tube, easier for puff. Inside diameter of the silicon tube optimized to easier replacing and seal. As an optimized example, inside the back housing designed with heat insulation layer, to reduce heat release.

Figure 22:
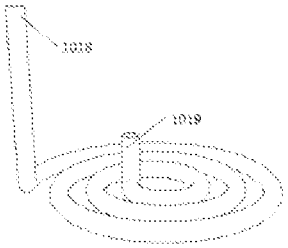
FIG. 22 is a 3D illustration of spiral air flow path.

As shown in FIG. 21 and FIG. 22 the characteristic of this example is spiral air flow path design. When smoker puffs, air flows into the spiral air flow path through opening 1018, the spiral air flow path attached with heat releasing part of heat collector to heat air flows in, high temperature air flows out of the spiral air flow path 1019 and targeting cigarette consumable item 1021 to heat and generate aerosol, at the same time aerosol could be puffed out by user.

Figure 23:
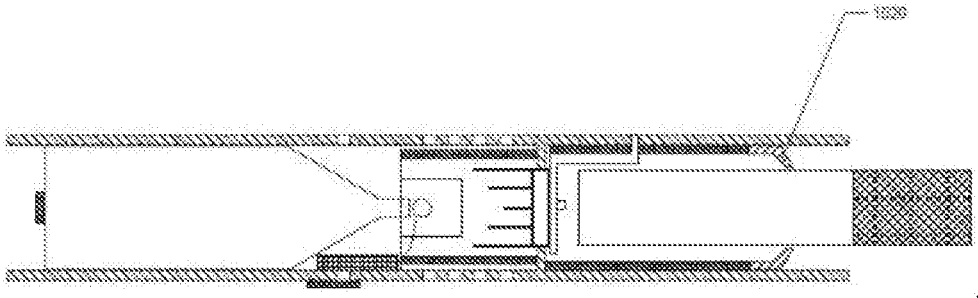
FIG. 23 is an illustration of simplified smoking article design, including spiral air flow path.
Figure 24:
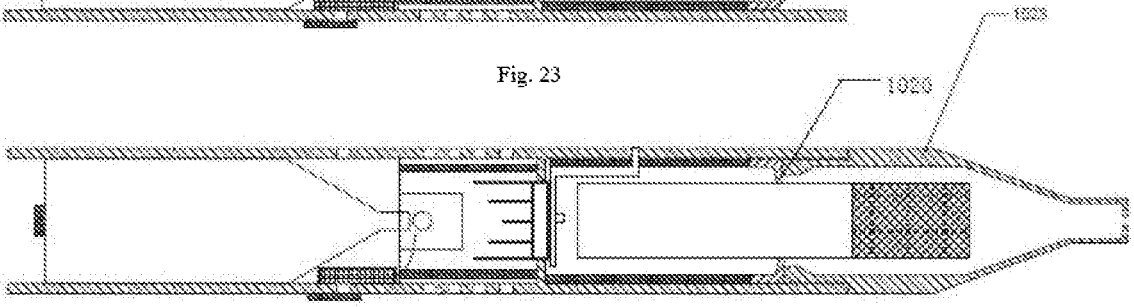
FIG. 24 is an illustration of removable puff mouth piece assembly.

As another solution for above example, FIG. 23 and FIG. 24 provides a smoking article, which is has removable smoking mouth piece 1023, connection could be but not limited to screw thread or nested. In this figure silicon tube 1020 placed in back housing, opening of silicon tube 1020 is horn shaped, make it easier to insert cigarette consumable items 1021. By connecting mouth piece 1023, mouth piece will squeeze the opening of silicon tube 1020 to make it deformation, results in silicon tube attaching to the cigarette consumable item tightly, to form a good seal and hold, makes air could not flow around the cigarette but only through the cigarette. Remove the mouth piece, the silicon tube also released, makes it easier to replace cigarette consumable item 1021.

The invention is not limited to the implementation of above examples. The above description of the specific implementation ways to explain this invention involved technical solutions. The specific implementation of the above ways used to reveal the best implementation method of the invention and to make technician in the field of application of the invention to achieve the purpose of the invention. Based on the invention revealed obvious transform or alternative should be considered in the scope of protection for the invention.

What is claimed is:

1. A gas heating smoking article with a puff mouth piece, comprising a smoking article housing, a combustion device attached on the housing, a push button attached to an end of the housing opposite to the combustion device, a plurality of cigarette consumable items or aerosol generation consumable items; wherein a propane or a butane premixed with air is used before a combustion, wherein a heat generated from the combustion is used to bake the plurality of cigarette consumable items or aerosol generation consumable items, wherein the plurality of cigarette consumable items are placed in a baking chamber, wherein the smoking article housing comprises an inlet air hole and the puff mouth piece; wherein the baking chamber comprises at least one high-temperature gas spread path and at least one exhaust gas exit; wherein the combustion of a gas-air-mixed flame is targeting the high-temperature gas spread path and connects to the exhaust gas exit, to realize a baking of the plurality of cigarette consumable items or aerosol generation consumable items; wherein there is no air flow path between the baking chamber and the puff mouth piece, wherein applying a force on the push button ejects a combustion gas from the combustion device, the combustion device ignites the gas to create a gas-air-mixed flame that bakes a section of the cigarette consumable items, and wherein subsequent application of force on the push button causes the combustion device to move along the smoking article section by section, wherein there is a lid on the housing, wherein the combustion device includes a fuel chamber, an ignition device, a gas refill port, an inlet air control switch and a premix chamber, wherein the premix chamber is provided with a combustion-supporting air inlet and nozzle, wherein the premixed flame spurts out of the nozzle, wherein the nozzle is provided with a flame stabilizer to stabilize the combustion and prevent a sudden flame-out; wherein the flame stabilizer is made of metal wire, wherein the premix chamber is provided with a flame muffler net wherein the baking chamber is divided into multiple separate chambers of 3-20 separate chambers, at least one of the plurality of cigarette consumable items is placed in one of the 3-20 separate chambers of the baking chamber, and wherein the high-temperature gas spread path and the exhaust gas exit are also divided into the 3-20 separate chambers of the baking chamber.

2. The smoking article of claim 1, wherein the separate chambers of the baking chamber are divided by a plurality of partitions, wherein the plurality of partitions are provided with a space for the plurality of cigarette consumable items; wherein there is one of the at least one high-temperature gas spread path and one of the at least one exhaust gas exit provided for each separate chamber, wherein each of the at least one high-temperature gas spread path forms a gap between the cigarette consumable item and the housing; wherein the combustion device is attached to an outside of the housing and capable of moving along the smoking article step by step; and at each stop point of a high-temperature gas inlet hole to the separate chambers, single combustion and step motion of the combustion device is controlled manually.

3. The smoking article of claim 2, wherein the combustion device is connected to an escapement system to make the combustion device move step by step, wherein the escapement system is located outside the housing and each stop point to make the combustion device target at least one of the high-temperature gas inlet holes.

4. The smoking article of claim 3, wherein a manual switch is provided to control the combustion device and the escapement system, or two switches are provided to control the combustion device and the escapement system separately.

5. The smoking article of claim 1, wherein the at least one high-temperature gas spread path is filled with a metal foam or a metal fiber to make a premixed flame and a premixed flameless combustion coexistent.

6. The smoking article of claim 1, wherein the premix chamber is made of heat resistance ceramic, with a plurality of inlet air flow holes at the side;

or the premix chamber is made of a wave shaped dual metal sheet, wherein the wave shaped dual metal sheet is extended and pressed to close an air flow valve, wherein a plurality of inlet air flow holes are provided at a side of the premix chamber.

* * * * *